US011075467B2

(12) United States Patent
Luo et al.

(10) Patent No.: US 11,075,467 B2
(45) Date of Patent: Jul. 27, 2021

(54) TWO-DIMENSIONAL ANTENNA AND NETWORK DEVICE

(71) Applicant: HUAWEI TECHNOLOGIES CO., LTD., Guangdong (CN)

(72) Inventors: Lijun Luo, Dongguan (CN); Lianhong Zhang, Munich (DE); Tingwei Xu, Shenzhen (CN); Zhi Gong, Dongguan (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 121 days.

(21) Appl. No.: 16/358,257

(22) Filed: Mar. 19, 2019

(65) Prior Publication Data

US 2019/0214740 A1 Jul. 11, 2019

Related U.S. Application Data

(63) Continuation of application No. PCT/CN2016/099393, filed on Sep. 19, 2016.

(51) Int. Cl.

| | |
|---|---|
| ***H01Q 21/00*** | (2006.01) |
| ***H01Q 21/06*** | (2006.01) |
| ***H01Q 21/30*** | (2006.01) |
| ***H01Q 21/29*** | (2006.01) |

(Continued)

(52) U.S. Cl.

CPC ..... *H01Q 21/061* (2013.01); *H01Q 15/14* (2013.01); *H01Q 21/0006* (2013.01);

(Continued)

(58) Field of Classification Search

CPC ..... H01Q 21/061; H01Q 21/29; H01Q 15/14; H01Q 21/0006; H01Q 21/30; H01Q 5/50

See application file for complete search history.

(56) References Cited

U.S. PATENT DOCUMENTS 6,339,407 B1 * 1/2002 Gabriel ..... H01Q 21/29 343/797

2013/0229308 A1 9/2013 Pu et al.

(Continued)

FOREIGN PATENT DOCUMENTS

CN 201130715 Y 10/2008
CN 101465472 A 6/2009

(Continued)

OTHER PUBLICATIONS

PCT International Search Report and Written Opinion issued in International Application No. PCT/CN2016/099393 dated Jun. 7, 2017, 17 pages (with English translation).

(Continued)

*Primary Examiner* — Dieu Hien T Duong
(74) *Attorney, Agent, or Firm* — Fish & Richardson P.C.

(57) ABSTRACT

The present disclosure relates to two-dimensional antennas and network devices. One example antenna includes a reflection panel, at least two antenna arrays, at least one common feeding network, and at least two array feeding networks. The at least two antenna arrays are on the reflection panel. Each antenna array comprises at least one independent radiation unit and at least one common radiation unit. Each antenna array corresponds to an array feeding network of the at least two array feeding networks. Each independent radiation unit in each antenna array is connected to a particular array feeding network corresponding to the particular antenna array. Each common radiation unit in each antenna array is connected to the at least one common feeding network. The at least one common feeding network is connected to the at least two array feeding networks corresponding to the at least two antenna arrays.

9 Claims, 6 Drawing Sheets

(51) Int. Cl.
*H01Q 15/14* (2006.01)
*H01Q 5/50* (2015.01)

(52) U.S. Cl.
CPC ..... *H01Q 21/29* (2013.01); *H01Q 21/30* (2013.01); *H01Q 5/50* (2015.01)

(56) References Cited

U.S. PATENT DOCUMENTS

| | | | | |
|---|---|---|---|---|
| 2014/0028516 | A1 | 1/2014 | Semonov et al. | |
| 2014/0225792 | A1 | 8/2014 | Lee et al. | |
| 2014/0242930 | A1* | 8/2014 | Barker ..... | H01Q 21/08 455/129 |

FOREIGN PATENT DOCUMENTS

| | | | |
|---|---|---|---|
| CN | 101848471 | A | 9/2010 |
| CN | 103026552 | A | 4/2013 |
| CN | 203260740 | U | 10/2013 |
| CN | 204497381 | U | 7/2015 |
| CN | 105356071 | A | 2/2016 |
| EP | 2538578 | A2 | 12/2012 |
| JP | S6382003 | A | 4/1988 |
| WO | 2013143445 | A1 | 10/2013 |

OTHER PUBLICATIONS

Office Action issued in Chinese Application No. 201680001439.3 dated Jul. 9, 2019, 7 pages.

Extended European Search Report issued in Application No. 16916072.8, dated Jul. 4, 2019, 10 pages.

EPO Communication pursuant to Article 94(3) EPC issued in European Application No. 16916072.8 dated Aug. 10, 2020, 6 pages.

* cited by examiner

TWO-DIMENSIONAL ANTENNA AND NETWORK DEVICE

CROSS-REFERENCE TO RELATED APPLICATIONS

This application is a continuation of International Application No. PCT/CN2016/099393, filed on Sep. 19, 2016, the disclosure of which is hereby incorporated by reference in its entirety.

TECHNICAL FIELD

This application relates to the field of antenna technologies, and in particular, to a two-dimensional antenna and a network device.

BACKGROUND

As wireless mobile communications develops, multi-frequency and multi-standard are a current prevailing trend. A solution of horizontal arrangement of multiple columns is usually used for a multi-frequency antenna to extend the antenna. Therefore, a horizontal dimension of the antenna and antenna weight are increased. Consequently, during actual application of the antenna, engineering difficulty and construction costs of a base station are increased due to an antenna array dimension and weight. Therefore, the antenna needs to be miniaturized while antenna performance is ensured.

At present, a multi-frequency antenna may be miniaturized by reducing a width of the multi-frequency antenna and reducing a wind load area of a multi-frequency antenna device, so as to reduce a requirement on strength of a tower on which the multi-frequency antenna is installed, and reduce construction costs of the tower. In addition, related engineering costs are also significantly reduced accordingly, and construction costs expenditure is effectively reduced.

However, a horizontal-plane beamwidth of an antenna is related to an antenna width, and a greater horizontal-plane beamwidth indicates a smaller antenna width. If the antenna works at a central frequency of 2 GHz, the horizontal-plane beamwidth of the antenna is 65 degrees when the antenna width is approximately 150 mm, and the horizontal-plane beamwidth of the antenna is 32 degrees when the antenna width is approximately 300 mm. Therefore, if a width of a multi-frequency antenna is reduced, a horizontal-plane beamwidth of each individual column of the multi-frequency antenna is increased. Consequently, radiation performance of a column directivity pattern of the antenna deteriorates. Therefore, how to implement a function of an antenna in smaller space while maintaining performance of the original antenna becomes a problem to be urgently resolved.

SUMMARY

Embodiments of this application provide a two-dimensional antenna and a network device, so as to reduce an antenna dimension while maintaining antenna performance.

An embodiment of this application provides a two-dimensional antenna, including:

a reflection panel, at least two antenna arrays, at least one common feeding network, and at least two array feeding networks, where the at least two antenna arrays are on the reflection panel, each of the at least two antenna arrays includes at least one independent radiation unit and at least one common radiation unit, each antenna array is corresponding to one array feeding network, each independent radiation unit in each antenna array is connected to the array feeding network corresponding to the antenna array, each common radiation unit in each antenna array is connected to the common feeding network, and the common feeding network is connected to the array feeding network corresponding to each of the at least two antenna arrays.

According to the two-dimensional antenna provided in this embodiment of this application, the array feeding network corresponding to each antenna array supplies power to all independent radiation units in the antenna array, and also supplies power to all common radiation units that access the array feeding network corresponding to the antenna array, so that the common radiation units and the independent radiation units form an array in a horizontal-plane direction. Therefore, radiation performance of the antenna array can be improved by reducing a horizontal-plane beamwidth of the antenna array.

Optionally, an array spacing between two neighboring antenna arrays in the at least two antenna arrays is greater than or equal to $0.5\lambda$ and less than or equal to $\lambda$, and $\lambda$ is a wavelength corresponding to a center frequency of the two-dimensional antenna.

Optionally, radiation units in two neighboring antenna arrays in the at least two antenna arrays are arranged in parallel.

Optionally, the common feeding network is a feeding network that includes a 90° bridge, or the common feeding network is a feeding network that includes a combiner.

In the foregoing solution, when the common feeding network is a feeding network that includes a 90° bridge or a feeding network that includes a combiner, coupling between electromagnetic signals of common radiation units that access a same common feeding network can be weakened, so that performance of isolation between antenna arrays is improved.

Optionally, each of the at least two antenna arrays includes a same quantity of common radiation units.

An embodiment of this application provides a two-dimensional antenna, including:

a reflection panel; and at least one antenna array and at least one common antenna array that are on the reflection panel, where each antenna array includes at least one independent radiation unit, and each common antenna array includes at least one common radiation unit, where each antenna array is corresponding to one array feeding network, the at least one common antenna array is corresponding to a common feeding network, each independent radiation unit in each antenna array is connected to the array feeding network corresponding to the antenna array, each common radiation unit in each common antenna array is connected to the common feeding network, and the common feeding network is connected to the array feeding network corresponding to each of the at least one antenna array.

According to the two-dimensional antenna provided in this embodiment of this application, the array feeding network corresponding to each antenna array supplies power to all independent radiation units in the antenna array, and also supplies power to all common radiation units that access the array feeding network corresponding to the antenna array, so that the common radiation units and the independent radiation units form an array in a horizontal-plane direction.

Therefore, radiation performance of the antenna array can be improved by reducing a horizontal-plane beamwidth of the antenna array.

Optionally, an array spacing between two neighboring arrays is greater than or equal to 0.5λ and less than or equal to λ, and λ is a wavelength corresponding to a center frequency of the two-dimensional antenna.

Optionally, the common feeding network is a feeding network that includes a 90° bridge, or the common feeding network is a feeding network that includes a combiner.

In the foregoing solution, when the common feeding network is a feeding network that includes a 90° bridge or a feeding network that includes a combiner, coupling between electromagnetic signals of common radiation units that access a same common feeding network can be weakened, so that performance of isolation between antenna arrays is improved.

Optionally, each of the at least one antenna array includes a same quantity of independent radiation units.

An embodiment of this application provides a network device that includes any one of the two-dimensional antennas described above.

DESCRIPTION OF EMBODIMENTS

Figure 1:
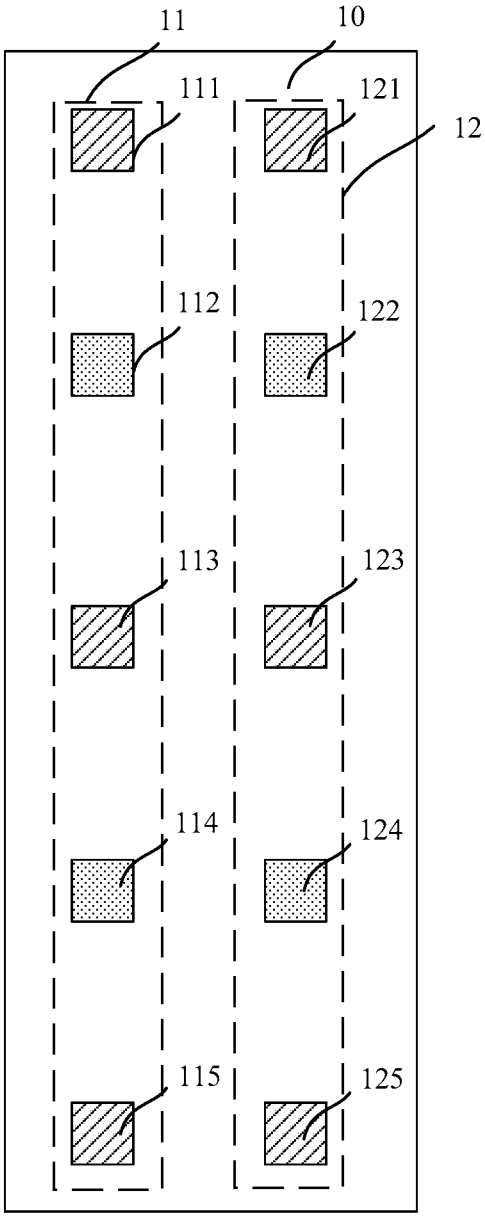
FIG. 1 is a schematic structural diagram of a two-dimensional antenna according to an embodiment of this application.

A two-dimensional antenna provided in embodiments of this application may be applied to a communications system in which a MIMO (Multi Input Multi Output) technology is used, such as an LTE (Long Term Evolution) system, and may also be applied to various communications systems such as a Global System for Mobile Communications (GSM), a Code Division Multiple Access (Code Division Multiple Access, CDMA) system, a Wideband Code Division Multiple Access (WCDMA) system, a general packet radio service (GPRS) system, and a Universal Mobile Telecommunications System (UMTS). The two-dimensional antenna provided in the embodiments of this application may further be applied to a multi-antenna application scenario, such as a scenario in which mobile network coverage is provided for different operators.

The antenna provided in the embodiments of this application includes: a reflection panel, where the reflection panel may be a metal material, that is, a metal reflection panel; and at least two antenna arrays on the reflection panel. Each antenna array includes at least one independent radiation unit and at least one common radiation unit, and each antenna array is corresponding to one array feeding network.

Each independent radiation unit in each antenna array is connected to the array feeding network corresponding to the antenna array, each common radiation unit in each antenna array is connected to a common feeding network, and the common feeding network is connected to the array feeding network corresponding to each of the at least two antenna arrays.

In the embodiments of this application, an array feeding network corresponding to each antenna array supplies power to all independent radiation units in the antenna array, and also supplies power to all common radiation units that access the array feeding network corresponding to the antenna array, so that the common radiation units and the independent radiation units form an array in a horizontal-plane direction. Therefore, radiation performance of the antenna array can be improved by reducing a horizontal-plane beamwidth of the antenna array.

In the embodiments of this application, radiation units in two neighboring antenna arrays in the at least two antenna arrays may be arranged in parallel, or may be arranged in a staggered manner. This is not limited in the embodiments of this application.

In the embodiments of this application, radiation units in the at least two antenna arrays are arranged along an axis of the reflection panel, or may be arranged in a staggered manner in a direction perpendicular to an axis. This is not limited in the embodiments of this application.

Radiation unit is a general term for the common radiation unit and the independent radiation unit.

In the embodiments of this application, each antenna array may include a same quantity of common radiation units or different quantities of common radiation units. This is not limited in the embodiments of this application. Correspondingly, each antenna array may include a same quantity of independent radiation units or different quantities of independent radiation units. This may be specifically determined according to an actual situation, and details are not described herein.

In the embodiments of this application, an array spacing between two neighboring antenna arrays in the at least two antenna arrays may be greater than or equal to 0.5λ and less than or equal to λ, and λ is a wavelength corresponding to a center frequency of the two-dimensional antenna.

Optionally, in the embodiments of this application, performance of isolation between antenna arrays is improved by weakening coupling between electromagnetic signals of common radiation units that access a same common feeding network. The common feeding network may be a feeding network that includes a 90° bridge, or the common feeding network may be a feeding network that includes a combiner.

Detailed descriptions are provided below with reference to the accompanying drawings.

As shown in FIG. 1, FIG. 1 is a schematic structural diagram of a two-dimensional antenna according to an embodiment of this application.

The two-dimensional antenna shown in FIG. 1 includes two antenna arrays. Each antenna array includes at least one independent radiation unit and at least one common radiation unit, and radiation units in two neighboring antenna arrays in the two antenna arrays are arranged in parallel. It should be noted that, for a scenario in which the two-dimensional antenna includes at least two antenna arrays, refer to descriptions related to FIG. 1. Details are not described herein.

In FIG. 1, there are two antenna arrays 11 and 12 on a reflection panel 10, and each antenna array includes three independent radiation units and two common radiation units.

Specifically, independent radiation units included in the antenna array 11 are 111, 113, and 115, and common radiation units included in the antenna array 11 are 112 and 114. Independent radiation units included in the antenna array 12 are 121, 123, and 125, and common radiation units included in the antenna array 12 are 122 and 124.

Figure 2:
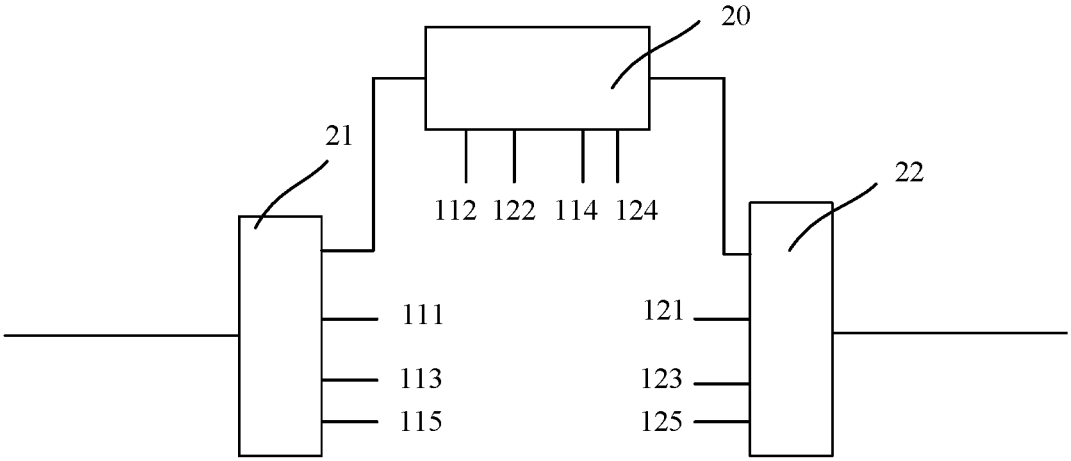
FIG. 2 is a schematic structural diagram of a feeding network according to an embodiment of this application.

With reference to FIG. 1, as shown in FIG. 2, FIG. 2 is a schematic structural diagram of a feeding network according to an embodiment of this application.

In FIG. 2, the common radiation units 112, 114, 122, and 124 in FIG. 1 are connected to a common feeding network 20; the independent radiation units 111, 113, and 115 in the antenna array 11 are connected to an array feeding network 21 corresponding to the antenna array 11; the independent radiation units 121, 123, and 125 in the antenna array 12 are connected to an array feeding network 22 corresponding to the antenna array 12. In addition, the common feeding network 20 is connected to the array feeding network 21 and the array feeding network 22.

By means of the foregoing connections, the common radiation units 112, 114, 122, and 124 are indirectly connected to the array feeding network 21 of the antenna array 11 by using the common feeding network 20, and are also indirectly connected to the array feeding network 22 of the antenna array 12.

When working, the array feeding network 21 of the antenna array 11 supplies power to the independent radiation units 111, 113, and 115 in the antenna array 11, and also supplies power to the common radiation units 112, 114, 122, and 124 that are indirectly connected to the array feeding network 21.

When working, the array feeding network 22 of the antenna array 12 supplies power to the independent radiation units 121, 123, and 125 in the antenna array 12, and also supplies power to the common radiation units 112, 114, 122, and 124 that are indirectly connected to the array feeding network 22.

As shown in FIG. 1, if a distance between the antenna arrays of the two-dimensional antenna is λ, and there is no common radiation unit in the antenna arrays, this scenario is corresponding to a conventional working scenario of an antenna array.

When the two antenna arrays work individually, horizontal-plane beamwidths of the antenna arrays are approximately 65°. When the two antenna arrays work simultaneously and have same input power, a horizontal-plane beamwidth of a new array formed by the two antenna arrays is approximately 32.5°, that is, half 65°. However, the array in this case is a new array formed by combing the two antenna arrays, an array quantity changes from 2 to 1, and an application scenario of a multi-input multi-output technology cannot not be met.

When a distance between the antenna arrays is continuously shortened, a horizontal-plane beamwidth when the antenna array works individually is gradually widened from approximately 65° to 90°. After the distance between the antenna arrays is shortened, the horizontal-plane beamwidth when the antenna array works individually is approximately 90°. If the common radiation units shown in FIG. 1 are disposed in the antenna array 11 and the antenna array 12, when working individually, the array feeding network 21 of the antenna array 11 supplies power not only to the independent radiation units 111, 113, and 115 in the antenna arrays, but also to the common radiation units 112, 122, 114, and 124 that are indirectly connected to the array feeding network 21. A horizontal-plane beamwidth of the antenna array 11 may be controlled at approximately 65° by adjusting a power ratio of the common feeding network 20 that accesses the array feeding network 21 to the array feeding network 21. Similarly, a similar working principle is used when the array feeding network 21 of the antenna array 12 works individually, and a horizontal-plane beamwidth of the antenna array 12 may also be controlled at approximately 65°. It should be noted that, in this embodiment of this application, the power ratio of the common feeding network 20 that accesses the array feeding network 21 to the array feeding network 21 may be adjusted by controlling a ratio of a supply voltage of the common radiation unit to a supply voltage of the independent radiation unit. In addition, the power ratio may be adjusted by using another method, and details are not described herein.

Therefore, in the two-dimensional antenna provided in this embodiment of this application, an array feeding network performs feeding on both the common radiation unit and the corresponding independent radiation unit, so that a horizontal-plane beamwidth can be reduced while the antenna is miniaturized, thereby improving radiation performance of an antenna array.

Figure 3:
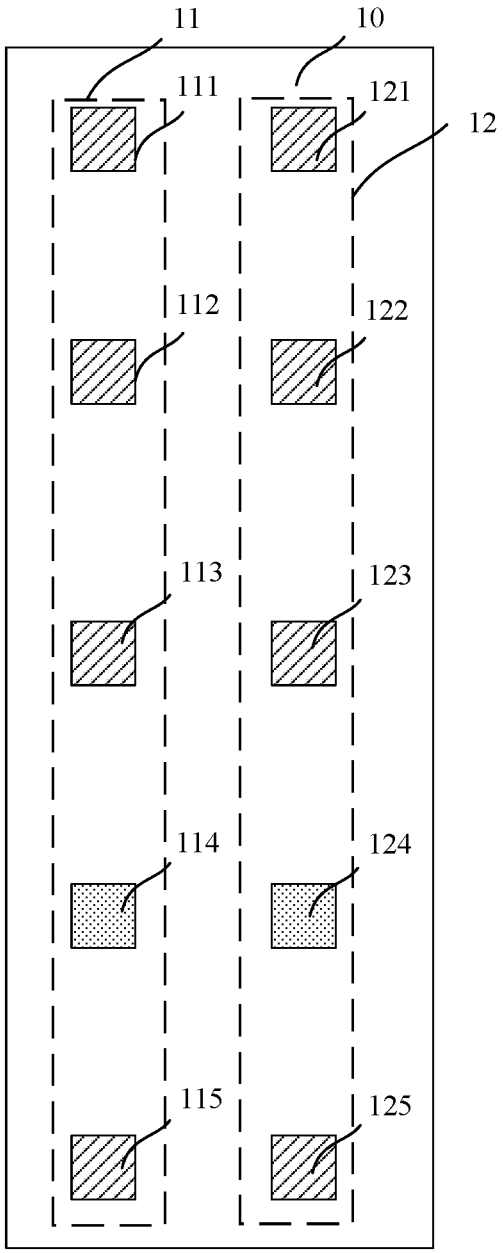
FIG. 3 is a schematic structural diagram of a two-dimensional antenna according to an embodiment of this application.

It should be noted that, a common radiation unit in each antenna array may be in any location, and there may be any quantity of common radiation units in each antenna array. This may be specifically determined according to an actual situation. For example, in FIG. 1, any one or more of the radiation units 111 to 115 may be used as common radiation units. With reference to FIG. 1, as shown in FIG. 3, FIG. 3 is a schematic structural diagram of a two-dimensional antenna according to an embodiment of this application. In FIG. 3, each antenna array includes only one common radiation unit. Specifically, independent radiation units included in an antenna array 11 are 111, 112, 113, and 115, and a common radiation unit included in the antenna array 11 is 114. Independent radiation units included in an antenna array 12 are 121, 122, 123, and 125, and a common radiation unit included in the antenna array 12 is 124. For other content in FIG. 3, refer to descriptions in FIG. 1. Details are not described herein again.

Figure 4:
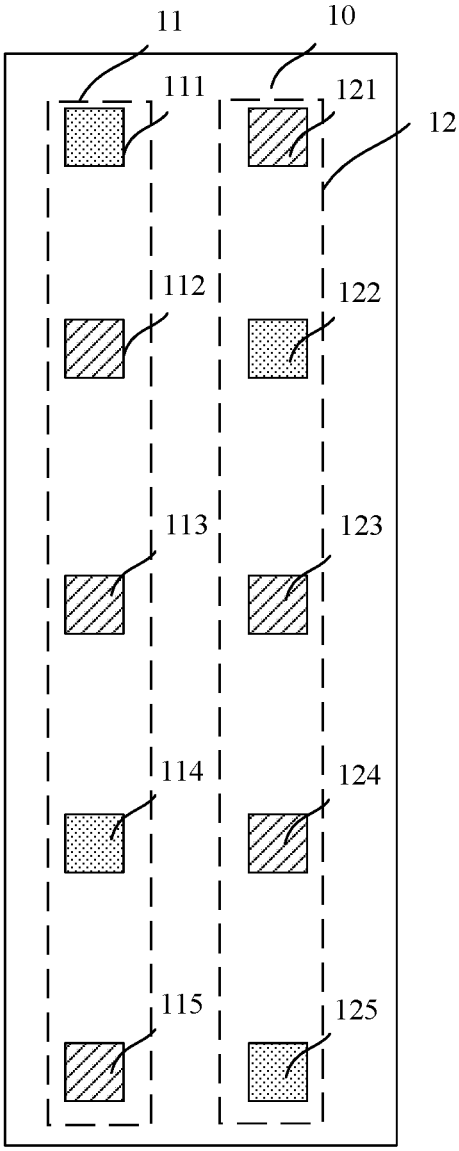
FIG. 4 is a schematic structural diagram of a two-dimensional antenna according to an embodiment of this application.

For another example, with reference to FIG. 1, as shown in FIG. 4, FIG. 4 is a schematic structural diagram of a two-dimensional antenna according to an embodiment of this application. In FIG. 4, common radiation units in each antenna array may be arranged in a staggered manner. Specifically, independent radiation units included in an antenna array 11 are 112, 113, and 115, and common radiation units included in the antenna array 11 are 111 and 114. Independent radiation units included in an antenna array 12 are 121, 123, and 124, and common radiation units included in the antenna array 12 are 122 and 125. For other content in FIG. 4, refer to descriptions in FIG. 1. Details are not described herein again.

Figure 5:
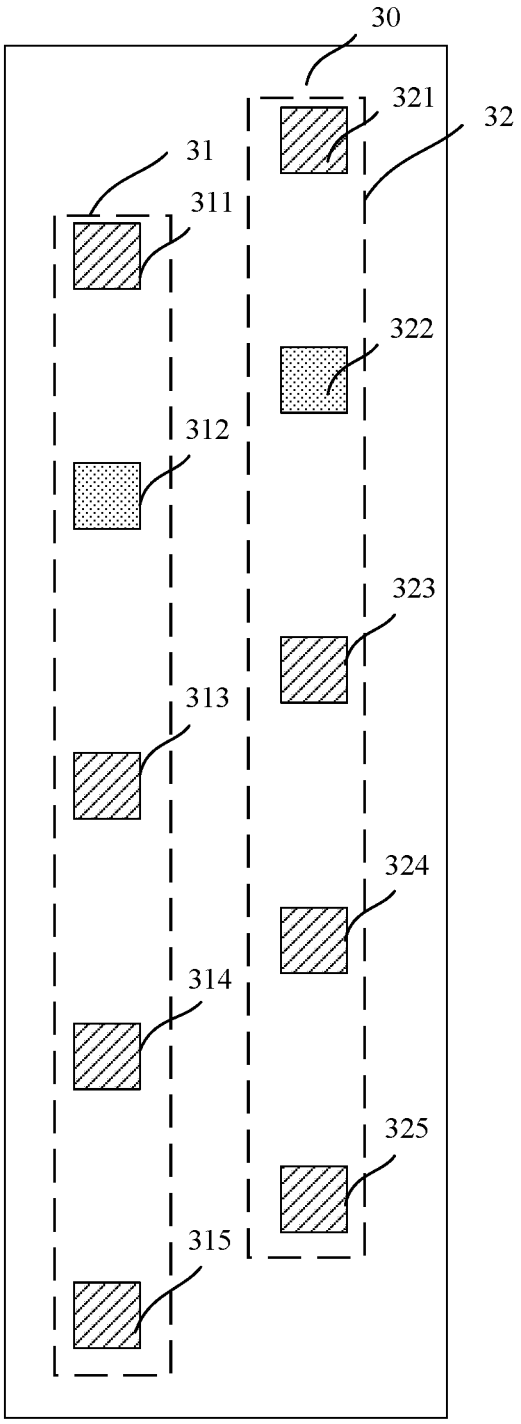
FIG. 5 is a schematic structural diagram of a two-dimensional antenna according to an embodiment of this application.

Radiation units of antenna arrays in the two-dimensional antenna provided in this embodiment of this application may be arranged in a staggered manner. Specifically, as shown in FIG. 5, FIG. 5 is a schematic structural diagram of a two-dimensional antenna according to an embodiment of this application. In FIG. 5, there are two antenna arrays 31 and 32 on a reflection panel 30, and each antenna array includes four independent radiation units and one common radiation units. Specifically, independent radiation units included in the antenna array 31 are 311, 313, 314, and 315, and a common radiation unit included in the antenna array 31 is 312. Independent radiation units included in the antenna array 32 are 321, 323, 324, and 325, and a common radiation unit included in the antenna array 32 is 322.

Neighboring radiation units in the antenna array 31 and the antenna array 32 are arranged in a staggered manner.

Certainly, the foregoing descriptions are merely examples. In the two-dimensional antenna provided in this embodiment of this application, a quantity and locations of independent radiation units included in each antenna array, and a quantity and locations of common radiation units may be in other forms, and details are not illustrated one by one herein. For details, refer to the foregoing descriptions.

Figure 6:
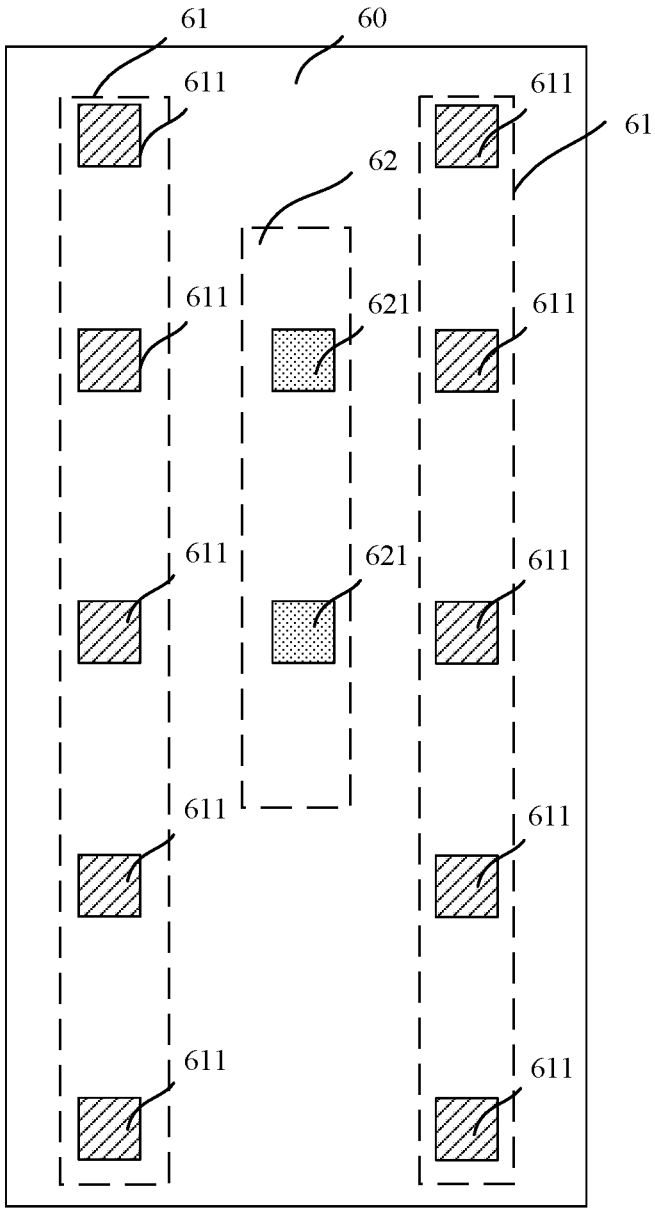
FIG. 6 is a schematic structural diagram of a two-dimensional antenna according to an embodiment of this application.

As shown in FIG. 6, FIG. 6 is a schematic structural diagram of a two-dimensional antenna according to an embodiment of this application.

In FIG. 6, the two-dimensional antenna includes: a reflection panel 60, and at least one antenna array 61 and at least one common antenna array 62 that are on the reflection panel 60. Each antenna array includes at least one independent radiation unit 611, and each common antenna array includes at least one common radiation unit 621.

Each antenna array is corresponding to one array feeding network, the at least one common antenna array is corresponding to a common feeding network, each independent radiation unit in each antenna array is connected to the array feeding network corresponding to the antenna array, each common radiation unit in each common antenna array is connected to the common feeding network, and the common feeding network is connected to the array feeding network corresponding to each of the at least one antenna array.

It should be noted that, in this embodiment of this application, each of the at least one antenna array may include a same quantity of independent radiation units, or different quantities of independent radiation units. This is specifically determined according to an actual situation, and details are not described herein.

Optionally, an array spacing between two neighboring arrays is greater than or equal to 0.5λ and less than or equal to λ, and λ is a wavelength corresponding to a center frequency of the two-dimensional antenna.

Optionally, the common feeding network may be a feeding network that includes a 90° bridge, or the common feeding network may be a feeding network that includes a combiner.

In this embodiment of this application, each antenna may include one common feeding network, or may include multiple common feeding networks. This is specifically determined an actual situation, and details are not described herein.

The two-dimensional antenna provided in this embodiment of this application may further include parts such as an antenna cover, a radio-frequency interface, and a waterproof coil. Details are not described herein.

An embodiment of this application further provides a network device that includes any one of the two-dimensional antennas described above.

The network device includes, but is not limited to, a base station, a node, a base station controller, an access point (AP), a macro station, a micro station or a small cell, a high-frequency station, a low-frequency station, a relay station, a part of functions of a base station, or an interface device of any other type that can work in a wireless environment. In addition, the "base station" includes, but is not limited to, a base station in a 4G system or a base station in a 5G system.

For other content of the network device, refer to descriptions in the prior art. Details are not illustrated one by one herein.

Obviously, a person skilled in the art can make various modifications and variations to this application without departing from the spirit and scope of this application. This application is intended to cover these modifications and variations of this application provided that they fall within the protection scope defined by the following claims and their equivalent technologies.

What is claimed is:

1. A two-dimensional antenna, comprising:

a reflection panel, at least two separated antenna arrays, at least one common feeding network, and at least two array feeding networks, wherein:

the at least two separated antenna arrays are on the reflection panel, each antenna array of the at least two separated antenna arrays comprises at least one independent radiation unit and at least one common radiation unit that is comprised only in the each antenna array, the each antenna array corresponds to an array feeding network of the at least two array feeding networks, each independent radiation unit in the each antenna array is connected to the array feeding network corresponding to the each antenna array, each common radiation unit in the each antenna array is connected to the at least one common feeding network, and the at least one common feeding network is connected to the at least two array feeding networks corresponding to the at least two separated antenna arrays.

2. The two-dimensional antenna according to claim 1, wherein an array spacing between two neighboring antenna arrays in the at least two separated antenna arrays is greater than or equal to 0.5λ, and less than or equal to λ, and wherein λ, is a wavelength corresponding to a center frequency of the two-dimensional antenna.

3. The two-dimensional antenna according to claim 1, wherein radiation units in two neighboring antenna arrays in the at least two separated antenna arrays are arranged in parallel.

4. The two-dimensional antenna according to claim 1, wherein the at least one common feeding network is a feeding network that comprises a 90° bridge or a combiner.

5. The two-dimensional antenna according to claim 1, wherein the each antenna array of the at least two separated antenna arrays comprises a same quantity of common radiation units.

6. A two-dimensional antenna, comprising:

a reflection panel; and at least one antenna array and at least one common antenna array that are on the reflection panel, wherein the at least one antenna array is separated from the at least one common antenna array, wherein each antenna array of the at least one antenna array comprises at least one independent radiation unit that is comprised only in the each antenna array, wherein each common antenna array of the at least one common antenna array comprises at least one common radiation unit that is comprised only in the each common antenna array, and wherein:

the each antenna array corresponds to an array feeding network, the at least one common antenna array corresponds to a common feeding network, each independent radiation unit in the each antenna array is connected to the array feeding network corresponding to the each antenna array, each common radiation unit in the each common antenna array is connected to the common feeding network, and the common feeding network is connected to at least one array feeding network corresponding to the at least one antenna array.

7. The two-dimensional antenna according to claim 6, wherein an array spacing between two neighboring antenna arrays is greater than or equal to 0.5λ and less than or equal to λ, and wherein λ is a wavelength corresponding to a center frequency of the two-dimensional antenna.

8. The two-dimensional antenna according to claim 6, wherein the common feeding network is a feeding network that comprises a 90° bridge or a combiner.

9. The two-dimensional antenna according to claim 6, wherein the each antenna array of the at least one antenna array comprises a same quantity of independent radiation units.

* * * * *